US005259507A

United States Patent [19]

Smith

[11] Patent Number: 5,259,507

[45] Date of Patent: Nov. 9, 1993

[54] TWIN-POCKET SHIPPING PACKAGE

[75] Inventor: Jeffrey A. Smith, Plainfield, N.J.

[73] Assignee: Squire Corrugated Container Corp., Linden, N.J.

[21] Appl. No.: 31,710

[22] Filed: Mar. 15, 1993

[51] Int. Cl.[5] ..... B65D 81/02

[52] U.S. Cl. ..... 206/583; 206/589; 206/591; 206/593

[58] Field of Search ..... 206/521, 583, 588, 589, 206/591, 593; 229/120.38

[56] References Cited

U.S. PATENT DOCUMENTS 3,669,337 6/1972 Struble ..... 206/583
4,087,003 5/1978 Adamek ..... 206/583
4,852,743 8/1989 Ridgeway ..... 206/521
4,923,065 5/1990 Ridgeway ..... 206/583
5,038,939 8/1991 Van Hest ..... 206/583
5,071,009 12/1991 Ridgeway ..... 206/583

*Primary Examiner*—David T. Fidei
*Attorney, Agent, or Firm*—Kirschstein, Ottinger, Israel & Schiffmiller

[57] ABSTRACT

A twin-pocket package provides a cushioned support for articles to be protected from impacts encountered during shipping and handling. Each pocket is formed between a resilient film and a foldable panel. The pockets have mouths that simultaneously expand or contract upon movement of the panel.

7 Claims, 2 Drawing Sheets

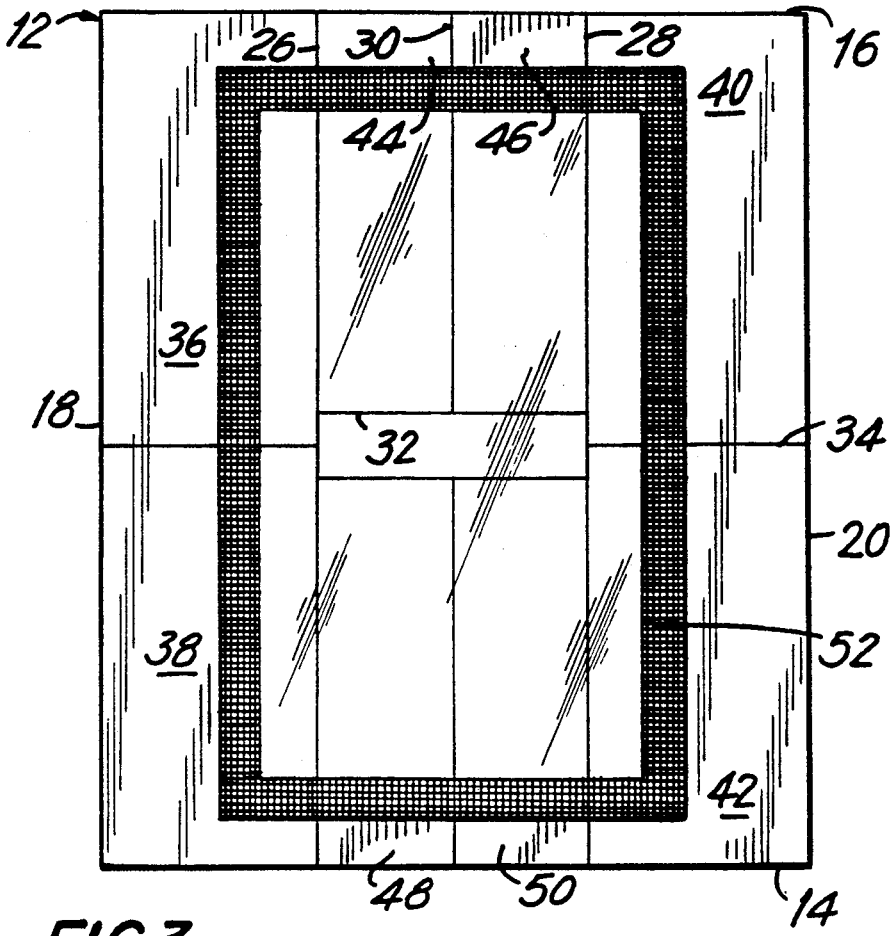
FIG.3
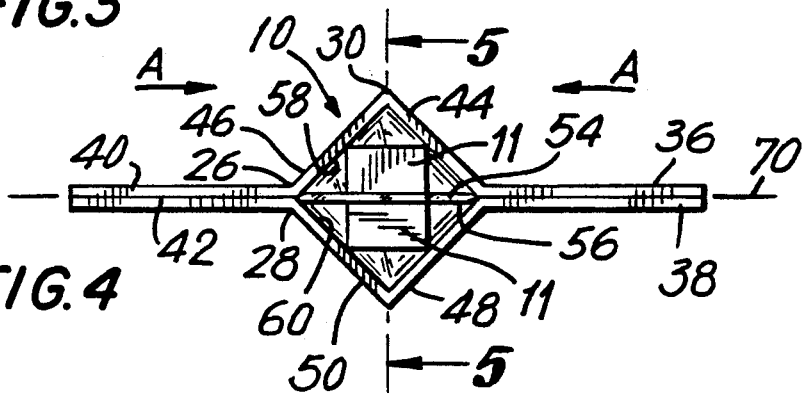
FIG.4
FIG.5
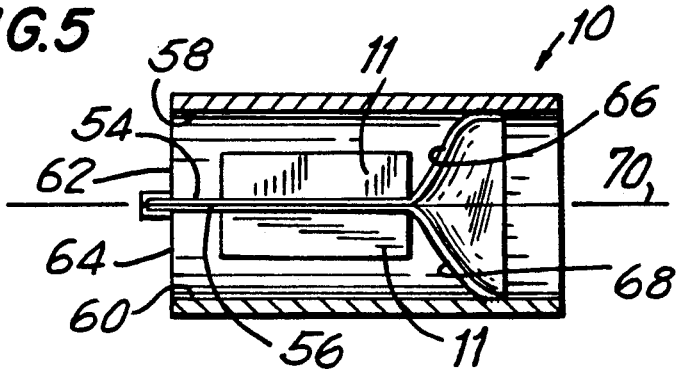

TWIN-POCKET SHIPPING PACKAGE

BACKGROUND OF THE INVENTION

1. Field of the Invention

This invention generally relates to a package for protecting an article from shipping and handling damage and, more particularly, to a twin-pocket shipping package for protecting a plurality of articles.

2. Description of Related Art

A shipping package must be able to withstand impact forces encountered during shipping and handling without transmitting excessive amounts of such forces to an article packaged therein. It is well known, for example, to package an article in a shipping container filled with such loose fill materials as foam, paper, wood chips, etc., or to cushion the article with an inflatable insert, or to support the article with rigid but deformable plastic inserts. It is also well known, for example, from U.S. Pat. Nos. 4,852,743 and 4,923,065 to sandwich an article between a pair of pliable, flexible membranes mounted on frames, thereby floatably suspending the article within the container.

Although the known packaging techniques are satisfactory for their intended purposes, experience has shown that there are many limitations in their practice. Thus, and by no means constituting an exhaustive list, foam is not readily recyclable or biodegradable; paper and wood chips put an ever-increasing burden on trees and the environment; inflatable inserts require sources of pressurized gas; and rigid but deformable inserts are not entirely satisfactory for delicate objects such as glass. Floating suspensions of the kind exemplified by the above patents may not contact the entire outer periphery of the article or may exert insufficient tension on the article being packaged.

It is also known to sandwich articles between a single membrane-mounted frame and the bottom of a container. However, in practice, the position of the frame shifts during shipping and handling, thereby providing inadequate protection for the article. Also, an inadequate tension may be exerted on the packaged article by the membrane on the frame.

SUMMARY OF THE INVENTION

1. Objects of the Invention

It is a general object of this invention to advance the state of the art of packaging.

It is another object of this invention to limit the extent of shipping and handling impact forces being transmitted to a packaged article.

Another object of this invention is to reliably protect more than one fragile article from breakage during shipping and handling.

2. Features of the Invention

In keeping with these objects, and others which will become apparent hereinafter, one feature of this invention resides, briefly stated, in a twin-pocket package for protecting articles. The package includes a panel having opposite major surfaces and a pair of outer strips spaced apart along a longitudinal direction and extending along a transverse direction normal to the longitudinal direction. The panel includes an opening extending along the longitudinal direction between the outer strips, and a pair of inner strips extending along the longitudinal direction between, and hinged along outer fold lines extending along the transverse direction to, the outer strips. The inner strips also extend away from each other and away from the opening along the transverse direction. Each inner strip has an inner fold line extending along the transverse direction and located between the outer fold lines.

The package further includes a resilient film stretched over the opening and attached to one of the major surfaces of the panel. The film itself is preferably light-transmissive, but may be opaque, is adhered to the panel by glue or other suitable adhesive, and is a flexible, stretchable, elastomeric membrane which may be made from a resilient laminate, woven fabric, netting, vinyl, polyethylene, or puncturable elastomeric film.

The panel also has a main fold line extending through the opening along the longitudinal direction and about which the outer strips are respectively folded over each other, the inner strips are folded over each other, and the film is folded over itself to form overlying film portions. One of the film portions and one of the inner strips form therebetween one pocket into which one of the articles is receivable. The other of the film portions and the other of the inner strips form therebetween another pocket into which another of the articles is receivable. The pockets have open ends which are expanded and contracted, respectively, upon movement of the outer strips along the longitudinal direction toward and away from each other.

In the preferred embodiment, the panel and the opening each have a generally rectangular shape. The opening is centrally positioned in the panel. The outer and inner fold lines are in mutual parallelism.

In use, the outer strips are initially moved along the longitudinal direction toward each other. This causes the inner strips to move away from each other due to outward folding along the inner and outer fold lines. The open ends of the pockets are now expanded in size and are ready to receive articles therein.

Once the articles have been loaded in the pockets, the outer strips are moved apart along the longitudinal direction. This causes the inner strips to move toward each other. The open ends of the pockets are now contracted in size, thereby resisting escape of the articles from the pockets. The package may now be positioned, together with additional such packages, in a larger shipping container for shipping and handling. Each package provides a highly reliable, impact-resistant, cushioned support.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is an enlarged, top plan view of the underside of the panel of FIG. 1;

FIG. 4 is a front elevational view of the package of FIG. 2; and

FIG. 5 is a sectional view taken on line 5—5 of FIG. 4.

DETAILED DESCRIPTION OF THE PREFERRED EMBODIMENT

Figure 2:
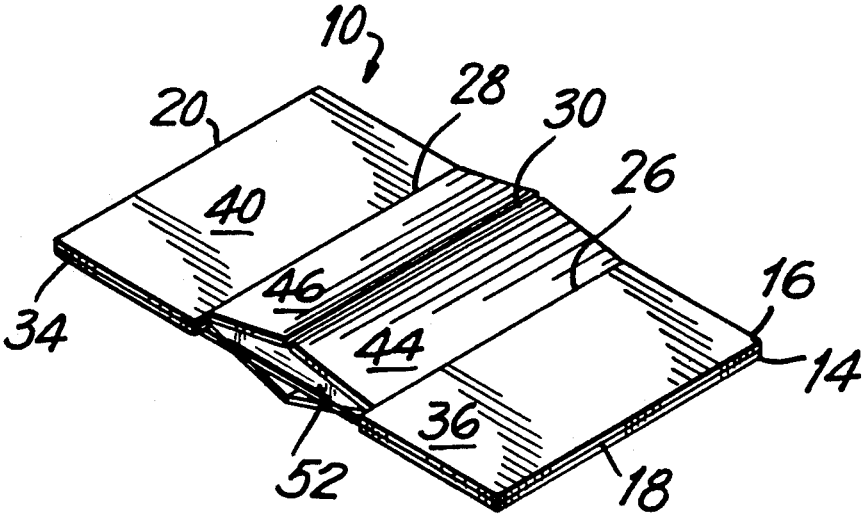
FIG. 2 is a perspective view of the panel of FIG. 1 after being folded into the twin-pocket package.

Referring now to the drawings, reference numeral 10 in FIGS. 2, 4 and 5 generally identifies a twin-pocket package for protecting articles 11 from damage during shipping and handling. As illustrated, each article 11 is a box. However, this was done merely for ease of illustration. Virtually any article can be protected according to this invention.

Figure 1:
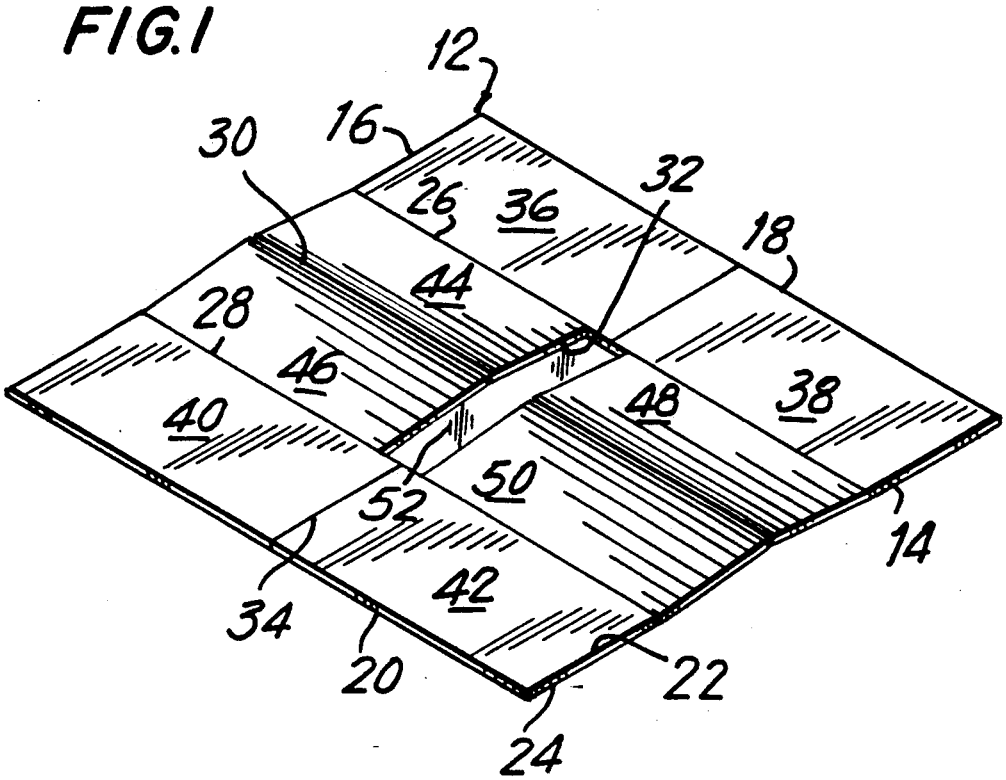
FIG. 1 is a perspective view of a film-mounted panel prior to being folded into a twin-pocket package for protecting articles according to this invention.

Turning to FIG. 1, the package 10 includes a generally planar, rectangular panel 12 having longitudinally-extending outer peripheral edges 14, 16 and transversely-extending outer peripheral edges 18, 20. Panel 12 has an upper major surface 22 and a lower opposite major surface 24. Panel 12 is constituted of a corrugated board material.

Panel 12 further has a first transversely-extending outer fold line 26 spaced from, and parallel to, transverse edge 18, and a second transversely-extending outer fold line 28 spaced from, and parallel to, transverse edge 20. A transversely-extending inner fold line 30 is located centrally between, and is parallel to, the outer fold lines 26, 28.

An opening 32, preferably of rectangular outline, is centrally formed in the panel 12. Opening 32 extends longitudinally between the outer fold lines 26, 28, and also extends transversely for a limited distance. A longitudinally-extending main fold line 34 extends along the panel through the opening 32, and is preferably symmetrically positioned between the longitudinal edges 14, 16.

A first panel portion 36 and a second panel portion 38 located on opposite sides of the main fold line 34 between the outer fold line 26 and the transverse edge 18, together constitute a first outer strip. A third panel portion 40 and a fourth panel portion 42 located on opposite sides of the main fold line 34 between the outer fold line 28 and the transverse edge 20, together constitute a second outer strip. The first and second outer strips are spaced longitudinally apart of each other.

A fifth panel portion 44 and a sixth panel portion 46 located on opposite sides of the inner fold line 30 between the opening 32 and the longitudinal edge 16, together constitute a first inner strip. A seventh panel portion 48 and an eighth panel portion 50 located on opposite sides of the inner fold line 30 between the opening 32 and the longitudinal edge 18, together constitute a second inner strip. The first and second inner strips are spaced transversely apart of each other.

The package further comprises a resilient film 52 stretched over the opening 32 and attached around its periphery to the lower surface 24 of the panel. As shown in FIG. 3, the film is glued to the panel with an adhesive applied in the cross-hatched border area.

The film is a flexible, stretchable, elastomeric membrane which may be made from a resilient laminate, woven fabric, netting, vinyl, polyethylene, or puncturable elastomeric film.

When the panel 12 and film 52 are folded over main fold line 34, then, as shown in FIG. 2, each pair of the panel portions 36, 38; 40, 42; 44, 48; and 46, 50 overlie each other. In addition, the film 52 is folded over itself to form overlying film portions 54, 56. As shown in FIGS. 4 and 5, film portion 54 forms a first pocket 58 with the inner strip 44, 46; and film portion 56 forms a second pocket 60 with the inner strip 48, 50. Articles 11 are inserted in the pockets. Each pocket has mouths or open front ends 62, 64 and closed rear ends 66, 68. The package has a central plane 70 relative to which the panel and the film are mirror-symmetrically arranged.

In use, when it is desired to insert the articles in the pockets, a user moves the first and second outer strips toward each other along the longitudinal direction (see arrows A in FIG. 4). This causes the inner strips to buckle outwardly at inner fold line 30. The panel portions 44, 48 move apart by pivoting about the outer fold line 26. The panel portions 46, 50 move apart by pivoting about the outer fold line 28. The front ends 62, 64 of the pockets expand in size to enable ready access to the pockets.

After being loaded, the user moves the first and second outer strips apart in the opposite direction indicated by arrows A, thereby causing the panel portions 44, 48 and 46, 50 to move together until the articles within the pockets are snugly frictionally engaged by the inner strips and the film portions. The high friction causes the articles to stay within the pockets.

The package and its articles, together with additional such packages, may now be placed within a larger shipping container.

It will be understood that each of the elements described above, or two or more together, also may find a useful application in other types of constructions differing from the types described above.

While the invention has been illustrated and described as embodied in a twin-pocket shipping package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A twin-pocket package for protecting articles, comprising:

(a) a panel having opposite major surfaces and (i) a pair of outer strips spaced apart along a longitudinal direction and extending along a transverse direction normal to the longitudinal direction, (ii) an opening extending along the longitudinal direction between the outer strips, and (iii) a pair of inner strips extending along the longitudinal direction between, and hinged along outer fold lines extending along the transverse direction to, the outer strips, said inner strips also extending away from each other and away from the opening along the transverse direction, each inner strip having an inner fold line extending along the transverse direction and located between the outer fold lines;

(b) a resilient film stretched over the opening and attached to one of the major surfaces of the panel; and (c) said panel having a main fold line extending through the opening along the longitudinal direction and about which the outer strips are respectively folded over each other, the inner strips are folded over each other, and the film is folded over itself to form overlying film portions, (i) one of the film portions and one of the inner strips forming therebetween one pocket into which one of the articles is receivable, and the other of the film portions and the other of the inner strips forming therebetween another pocket into which another of the articles is receivable, (ii) said pockets having open ends which are expanded and contracted, respectively, upon movement of the outer strips along the longitudinal direction toward and away from each other.

2. The twin-pocket package according to claim 1, wherein the opening has a rectangular configuration.

3. The twin-pocket package according to claim 1, wherein the opening is centrally positioned in the panel.

4. The twin-pocket package according to claim 1, wherein the panel is constituted of a corrugated board material.

5. The twin-pocket package according to claim 1, wherein the film is a flexible, pliant membrane adhered to said one major surface of the panel.

6. The twin-pocket package according to claim i, wherein the outer and inner fold lines are mutually parallel to one another.

7. The twin-pocket package according to claim 1, wherein the main fold line is symmetrically positioned on the panel.

* * * * *